US006532929B2

(12) United States Patent
Antonevich et al.

(10) Patent No.: US 6,532,929 B2
(45) Date of Patent: Mar. 18, 2003

(54) VENTED FASTENER

(75) Inventors: John M. Antonevich, Jamestown, NY (US); Timothy J. Buerkle, Sugar Grove, PA (US); John Findlay, Jamestown, NY (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/817,510

(22) Filed: Mar. 26, 2001

(65) Prior Publication Data

US 2002/0108598 A1 Aug. 15, 2002

Related U.S. Application Data

(60) Provisional application No. 60/192,189, filed on Mar. 27, 2000, and provisional application No. 60/192,768, filed on Mar. 28, 2000.

(51) Int. Cl.[7] ..... F02F 7/00
(52) U.S. Cl. ..... 123/195 R
(58) Field of Search ..... 123/195 R, 193.5, 123/193.3, 195 C, 195 H

(56) References Cited

U.S. PATENT DOCUMENTS

| | | | | |
|---|---|---|---|---|
| 80,435 A | | 7/1868 | Way | |
| 131,408 A | | 9/1872 | Peacock | |
| 2,320,398 A | | 6/1943 | Zetterquist | |
| 3,209,640 A | | 10/1965 | Waivers | |
| 3,408,812 A | | 11/1968 | Stenger | |
| 4,302,941 A | | 12/1981 | DuBell | |
| 4,597,258 A | | 7/1986 | Harris | |
| 4,748,806 A | | 6/1988 | Drobny | |
| 4,749,029 A | | 6/1988 | Becker et al. | |
| 4,749,298 A | | 6/1988 | Bundt et al. | |
| 4,820,097 A | | 4/1989 | Maeda et al. | |
| 4,944,151 A | | 7/1990 | Hovnanian | |
| 5,080,542 A | | 1/1992 | Sheahan | |
| 5,129,447 A | | 7/1992 | Hamner | |
| 5,220,854 A | | 6/1993 | Allart et al. | |
| 6,016,783 A | * | 1/2000 | Begin | 123/193.5 |

FOREIGN PATENT DOCUMENTS

| | | | |
|---|---|---|---|
| EP | 0 021 161 A2 | | 1/1981 |
| JP | 3-51797 A | * | 3/1991 |

* cited by examiner

*Primary Examiner*—John Kwon
*Assistant Examiner*—Hyder Ali
(74) *Attorney, Agent, or Firm*—Woodard, Emhardt, Naughton, Moriarty & McNett LLP

(57) ABSTRACT

A fastener for venting gas around the shank of the fastener. The present invention includes various embodiments for venting gases such as combustion gases that seep from a head gasket of an internal combustion engine to the area around the shank of a cylinder head bolt, as one example. The various vent paths include vent paths directly through the bolt, past the bearing surface of the bolted member, or past a washer between the fastener and the bolted member. These vent paths prevent gases from building up in the chamber between the fastener shank and the clearance hole of the bolted member.

10 Claims, 5 Drawing Sheets

VENTED FASTENER

This application claims priority to U.S. Provisional Patent Applications serial No. 60/192,189 filed Mar. 27, 2000 and No. 60/192,768 filed Mar. 28, 2000, both incorporated herein by reference.

FIELD OF THE INVENTION

The following invention relates to fasteners for coupling one or more devices which leak gas, and more specifically, to a fastener for coupling a cylinder head to an internal combustion engine.

BACKGROUND OF THE INVENTION

A common design practice for internal combustion engines is to fasten the cylinder head to the engine block by means of bolts. This bolted joint also compresses a gasket for sealing various operating fluids including combustion gases. Under some conditions and over extended time intervals combustion gas seepage occurs across the gasket and into the closed annular cavity defined by the shank of the bolt and the through hole in the head. Water vapor and corrosive agents in this gas can collect in sufficient concentrations to cause significant corrosion on exposed metal surfaces. This situation is aggravated further if one end of the cavity is cooler than the other, resulting in a crude heat pipe. In this case, vapor concentration can become high enough at the cold end to actually condense on exposed surfaces. An example of this is a bolt located inside an air intake passage where passing air cools the head of the bolt relative to the threaded end. Such designs are prone to stress corrosion fatigue failure of the bolt at or near the point where the shank and the head of the bolt intersect.

Documents including various fastening and attachment concepts are shown in U.S. Pat. No. 80,435 to Way, issued Jul. 28, 1868; U.S. Pat. No. 131,408 to Peacock, issued Sep. 17, 1872; U.S. Pat. No. 2,320,398 to Zetterquist, issued Jun. 1, 1943; U.S. Pat. No. 3,209,640 to Waivers, issued Oct. 5, 1965; U.S. Pat. No. 3,408,812 to Stenger, issued Nov. 5, 1968; U.S. Pat. No. 4,302,941 to DuBell, issued Dec. 1, 1981; U.S. Pat. No. 4,597,258 to Harris, issued Jul. 1, 1986; U.S. Pat. No. 4,748,806 to Drobny, issued Jun. 7, 1988; U.S. Pat. No. 4,749,029 to Becker et al., issued Jun. 7, 1988; U.S. Pat. No. 4,749,298 to Bundt et al., issued Jun. 7, 1988; U.S. Pat. No. 4,820,097 to Maeda et al, issued Apr. 11, 1989; U.S. Pat. No. 4,944,151 to Hovnanian, issued Jul. 31, 1990; U.S. Pat. No. 5,080,542 to Sheahan, issued Jan. 14, 1992; U.S. Pat. No. 5,129,447 to Hamner, issued Jul. 14, 1992; U.S. Pat. No. 5,220,854 to Allart et al., issued Jun. 22, 1993; and European Patent No. 0 021 161 published Jan. 7, 1981.

The present inventions describes a novel and unobvious way to reduce corrosion of a fastener.

SUMMARY OF THE INVENTION

One embodiment of the present invention is a unique apparatus to fasten together two members. The apparatus includes means for establishing fluid communication from an area within one of the fastened members to an area external to both fastened members, the means for establishing fluid communication being part of the apparatus.

Another embodiment of the present invention includes a method for coupling two members together. The method includes coupling the members together, forming a chamber between the two members, and venting any gas within the chamber.

Yet another embodiment of the present invention includes coupling a cylinder head of an internal combustion engine to a second member with a fastener, and including means for venting gas which flows into a chamber defined between the fastener and the cylinder head.

These and other embodiments of the present invention will be described in the Description of the Preferred Embodiment, the claims, and the drawings to follow.

DESCRIPTION OF THE PREFERRED EMBODIMENT

Figure 3:
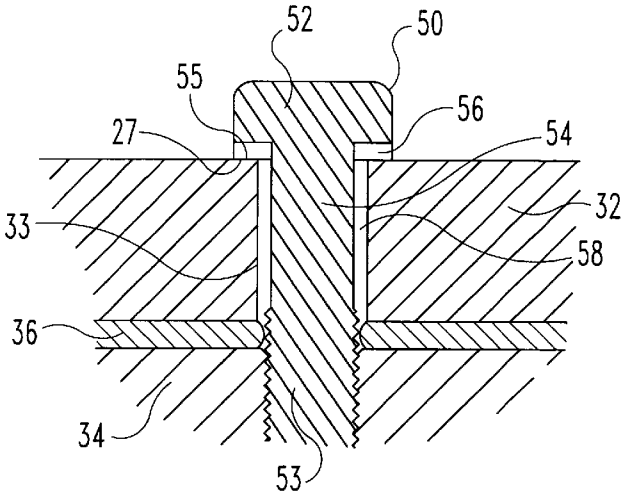
FIG. 3 is a cross-sectional view of a fastener coupling a cylinder head to an engine block according to another embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
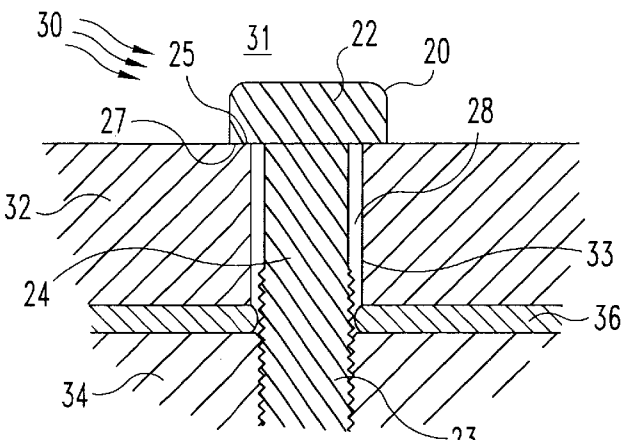
Fig. 1 (PRIOR ART)
FIG. 1 is a cross-sectional view of a prior art fastener coupling a cylinder head to an engine block.

FIG. 1 is a cross-sectional view of a prior art method of coupling a cylinder head to an engine. A threaded fastener 20 couples cylinder head 32 to engine block 34 for an internal combustion engine. Fastener 20 includes a head 22, and a shank with an unthreaded portion 24 and a threaded portion 23. Cylinder head 32 defines a hole 33 through which the shank of fastener 20 passes. Use of fastener 20 to couple cylinder head 32 to an engine results in the formation of an annular volume or annular chamber 28 between the inner diameter of hole 33 and the outer diameter of the shank of the fastener. Threaded shank 23 is threadably coupled to a threaded hole within engine block 34. Tightening of fastener 20 places bearing surface 25 of head 22 into contact with bearing surface 27 of cylinder head 32. Further tightening of fastener 20 results in compression between bearing surfaces 25 and 27, and also compression of head gasket 36. Head gasket 36 seals the interface between cylinder head 32 and block 34 so that combustion gases do not readily escape from the combustion chambers (not shown).

However, combustion gases can seep around head gasket 36 and enter chamber 28. These combustion gases include various combustion by-products, including water vapor, oxides of nitrogen, and sulfur dioxide. These gases can remain trapped in chamber 28 in those situations in which there is a seal formed between threaded portion 23 of the shank and the threaded hole of the engine block on one end, and on the other end, between bearing surfaces 25 and 27. The presence of combustion by-products in chamber 28 can result in corrosion of those surfaces exposed to the combustion gases.

Figure 12:
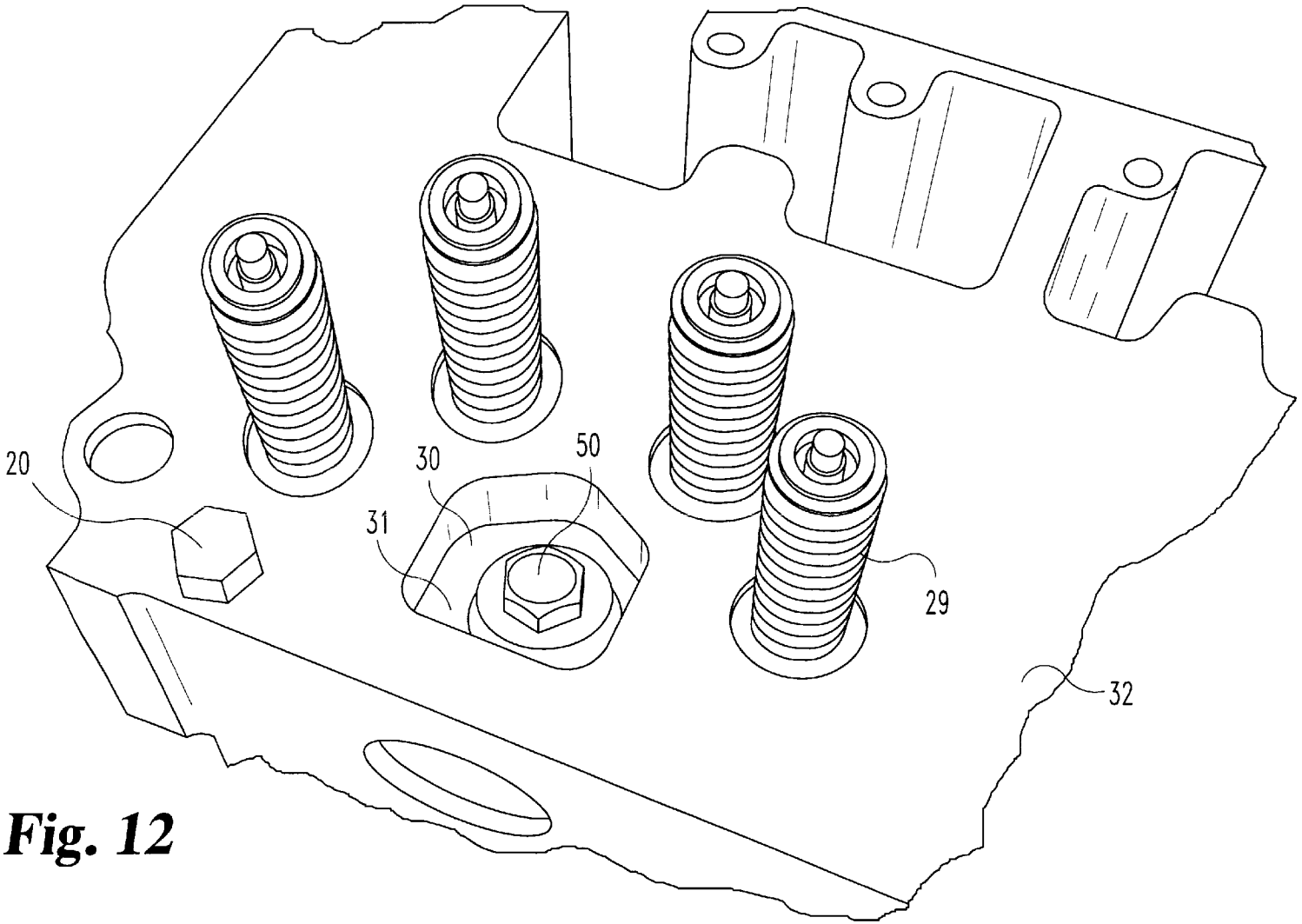
FIG. 12 is a perspective view of a portion of an internal combustion engine including a fastener according to one embodiment of the present invention.

In some situations where a portion of fastener 20 is cooled the presence of combustion gases in chamber 28 may be particularly problematic. For example, some internal combustion engines have one or more fasteners coupling the cylinder head to the engine with a portion of the fastener being exposed to intake air 30 flowing within an intake passage 31 (See FIG. 12). FIG. 12 depicts a vented fastener 50 according to one embodiment of the present invention within an intake passage 31, and surrounded by valve springs 29. As the intake air 30 washes over head 22 of fastener 20, both head 22 and unthreaded portion 24 of the shank may be cooled significantly. As these cooled portions of the fastener come into contact with the combustion gases seeping past gasket 36, the water vapor within the gas may condense on the fastener. In particular, the water vapor may condense on an undercut area where unthreaded portion 24 of the shank joins head 22. The condensed water vapor acts as a getter for the oxides of sulfur and nitrogen in the gas, with the resultant formation of sulfuric acid and/or nitric acid. The presence of these acids causes stress corrosion of the fastener, particularly in the undercut area, with resultant failure of the fastener.

The present invention solves this problem by providing means for venting gas from within the annular chamber 28. By allowing these combustion gases to escape the chamber the formation of liquid water and subsequent acids is reduced or greatly minimized. The life of the fastener is thereby extended. Although what will be shown and described are fasteners for coupling a cylinder head to an internal combustion engine, the apparatus and methods described are equally applicable to fasteners coupling any two members together in which one of the members provides a corrosive or potentially corrosive gas in the chamber surrounding the shank, or to other situations in which it is desirable to vent gases that build up around the shank of a fastener, or more broadly to those situations in which it is desirable to provide fluid communication from the head of the fastener to a chamber surrounding the shank (threaded or unthreaded) of the fastener.

Figure 2:
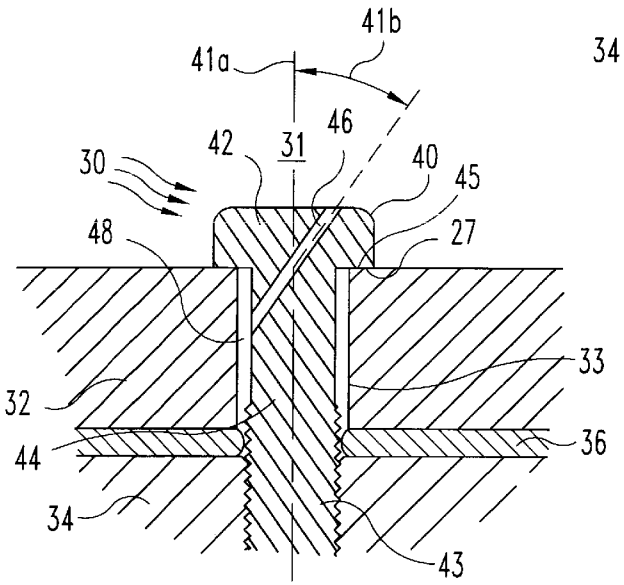
FIG. 2 is a cross-sectional view of a fastener coupling a cylinder head to an engine block according to one embodiment of the present invention.

FIG. 2 is a cross-sectional view of one embodiment of the present invention. A fastener 40 is shown extending through a hole 33 within a cylinder head 32. Fastener 40 includes a head 42 and a shank with an unthreaded portion 44. Threaded portion 43 of the shank is threadably coupled into a threaded hole of an engine block 34 until bearing surface 45 of fastener 40 is in contact and compression against bearing surface 27 of first member 32. A gasket 36 is compressed between first member 32 and second member 34. It is to be understood that the embodiments shown in FIGS. 3, 9 and 10 preferably likewise include a threaded shank portion threadably received within a threaded hole of a member such as an engine block, the cylinder head and the member compressing a gasket therebetween. Further, it is also understood that the embodiments shown in FIGS. 2, 3, 9 and 10 preferably include the head of the fastener being exposed and washed over by intake air 30 flowing within an interior passage.

Although what has been shown and described is a fastener with a portion thereof being exposed to and washed over by intake air, the present invention also contemplates those embodiments in which any vents, channels, means for venting, or means for fluid communication fluidly or flowingly connect the annular volume around the shank of the fastener to any conditions which the head of the fastener is exposed to, including ambient air.

Placement of fastener 40 within hole 33 defines and forms an annular volume or, annular chamber 48 therebetween. Fastener 40 includes a hole 46 which provides fluid communication from chamber 48 to an area outside of the head of fastener 40, which can be the interior of an intake passage 31. Hole 46 is preferably inclined at an oblique angle 41*b* from the centerline 41*a* of fastener 40, although the present invention also contemplates those embodiments in which hole 46 is generally parallel with centerline 41*a*, and also those embodiments in which hole 46 includes a first portion generally parallel with centerline 41*a* and a second portion through the head of the fastener inclined at an angle relative to the first portion of the hole.

FIG. 3 is a cutaway view of a fastener 50 according to another embodiment of the present invention coupling a cylinder head 32 to an engine. Fastener 50 includes a head 52, an unthreaded portion 54 of a shank, and a threaded portion 53 of the shank. An annular chamber 58 is formed between hole 33 of block 32 and unthreaded portions 54 and threaded portion 53, respectively. Although what is shown and described herein are fasteners including an unthreaded portion of a shank, it is understood that the present invention also contemplates those fasteners without an unthreaded portion. Further, the annular chamber or volume referred to herein is formed between the clearance hole of the first member and any portions of the fastener within the clearance hole. As fastener 50 is tightened, bearing surface 55 of fastener head 52 comes into contact with bearing surface 27 of cylinder head 32.

Figure 4:
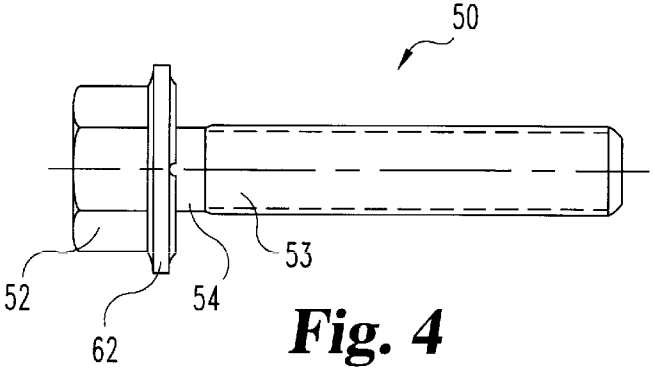
FIG. 4 is a side elevational view of the fastener of FIG. 3.
Figure 5:
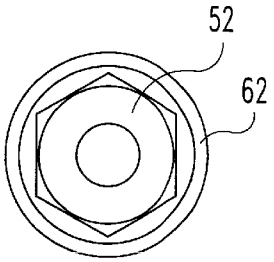
FIG. 5 is an end elevational view of the fastener of FIG. 4.

Fastener 50 includes at least one channel 56 in bearing surface 55 which provides fluid communication from within chamber 58 to the area outside of fastener 50. FIGS. 4, 5, 6, 7, and 8, show various views of fastener 50. Referring to FIGS. 4 and 5, fastener head 52 preferably includes a hex-shaped portion for providing torque to the fastener, and a wider, circular flange portion 62. Unthreaded portion 54 of the fastener shank extends perpendicularly from flange 62. A threaded portion 53 of the shank extends from unthreaded portion 54 to the end of the shank. Although FIGS. 4–8 depict a bolt of specific dimensions, those of ordinary skill in the art will recognize that the principals of this invention apply to fasteners of various dimensions and shapes. Further, the present invention contemplates fastener heads of any variety, including 12-point and 6-point heads, Allen-configuration heads, or any other type of fastener heads suitable for torquing.

Figure 6:
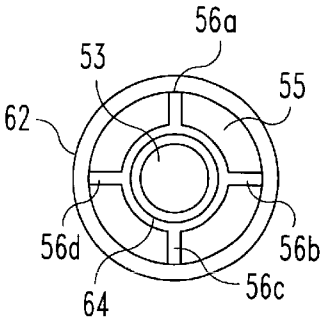
FIG. 6 is an end elevational view of the fastener of FIG. 4.

Referring to FIG. 6, the underside of flange 62 is shown to preferably include four channels 56*a*, 56*b*, 56*c*, and 56*d*, extending from a point near the outer diameter of unthreaded portion 54 of the shank and across bearing surfaces 55. Channels 56*a*, 56*b*, 56*c*, and 56*d* provide fluid communication from an area adjacent to portion 54 of the shank across bearing surfaces 55 to an area outside of the head 52 of fastener 50. Although FIG. 6 shows four channels, those of ordinary skill in the art will recognize that a single channel provides sufficient fluid communication to vent any gases flowing into chamber 58.

Figure 7:
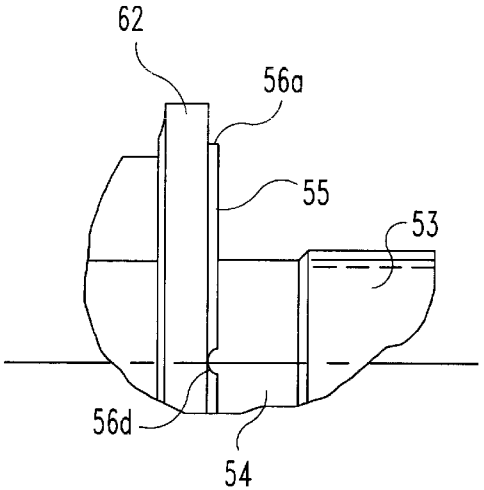
FIG. 7 is an enlarged view of a portion of the fastener of FIG. 4.

FIG. 7 shows a close-up of fastener 50 in the vicinity of flange 62 and unthreaded portion 54 of the shank. Channel 56*d* is shown in end view. In a preferred embodiment, channel 56*d* has a radius of about 1 mm and extends into bearing surface 55 by 0.6 mm. Those of ordinary skill in the art will recognize other dimensions for these channels which are large enough to permit adequate venting of gases. In the preferred embodiment shown in FIG. 7, bearing surface 55 has a diameter of about 27 mm. Although specific dimensions for a preferred embodiment are disclosed, the present invention is not limited to the specific dimensions provided herein.

Figure 8:
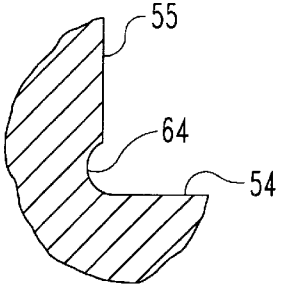
FIG. 8 is an enlarged portion of the fastener of FIG. 7.

FIG. 8 shows a close-up of the undercut portion of fastener 50 where the shank of the fastener meets the head of the fastener. Undercut 64 has a radius of about 0.9 mm.

Figure 9:
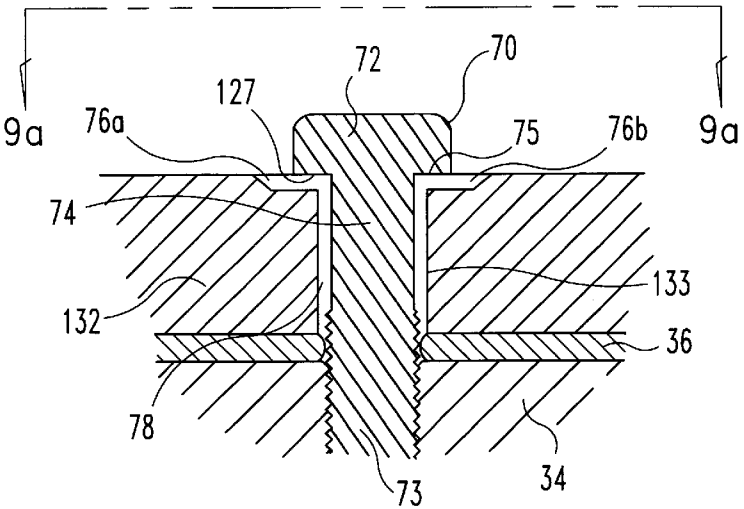
FIG. 9 is a cross-sectional view of a fastener coupling a cylinder head to an engine block according to another embodiment of the present invention.
Figure 9A:
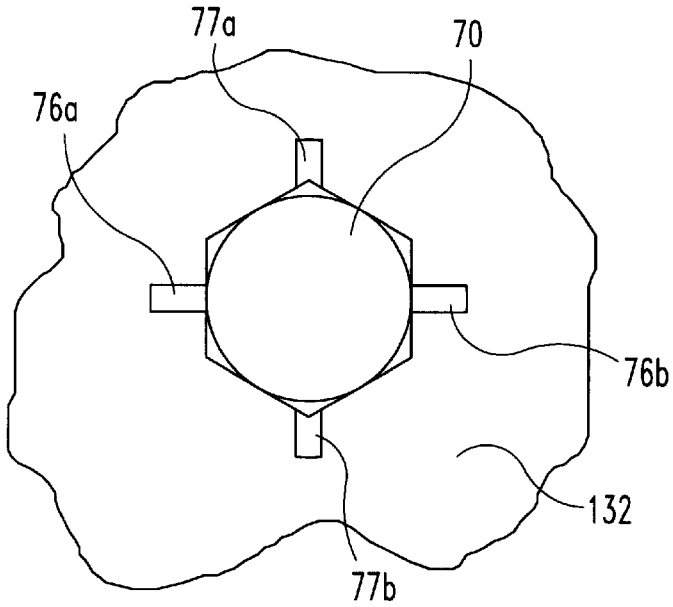
FIG. 9*a* is a top view of the fastener and cylinder head of FIG. 9.

FIGS. 9 and 9*a* show cross-sectional and top views, respectively, of another embodiment of the present invention. A fastener 70 is shown coupling a cylinder head 132 to an engine. Insertion of fastener 70 into hole 133 of head 132 forms an annular chamber 78 between unthreaded and threaded portions 74 and 73, respectively, of the shank and the inner diameter of the hole 133. Tightening of fastener 70 results in contact between bearing surface 75 of head 72 and bearing surface 127 of cylinder head 132. At least one channel 76 is formed on the surface of the cylinder head. Channel 76 my be formed by any convenient method, including casting or milling. Channel 76 provides fluid communication from chamber 78 to the area around bolt head 72, such that combustion gases within chamber 78 can escape through vent 76. As shown in FIGS. 9 and 9*a*, preferably at least two right and left channels 76*a* and 76*b*, respectively, are machined or otherwise formed in the surface of cylinder head 132, and thereby bisect bearing surface 127 into two halves. Some embodiments of the present invention further include channels sections 77*a* and 77*b*, as best seen in FIG. 9*a*, which are machined or otherwise formed in the surface of cylinder head 132 and spaced apart from channels 76*a* and 76*b*.

Figure 10:
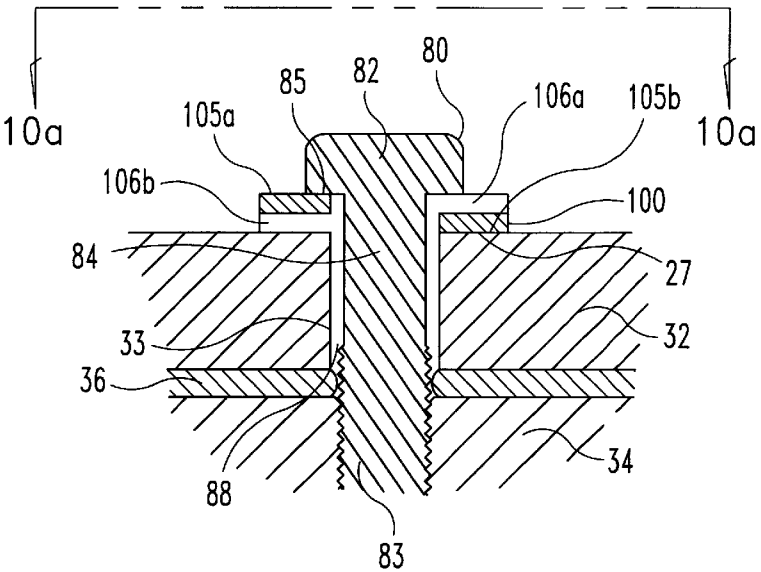
FIG. 10 is a cross-sectional view of a fastener and washer coupling a cylinder head to an engine block according to another embodiment of the present invention.
Figure 10A:
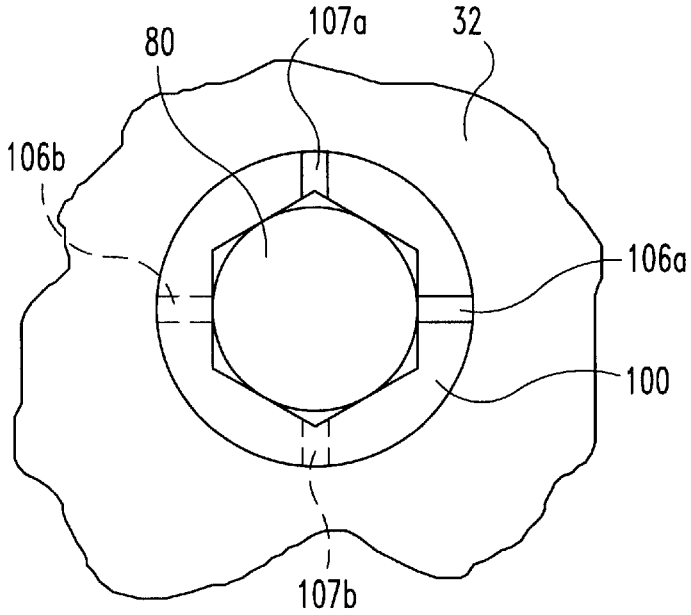
FIG. 10*a* is a top view of the fastener, washer, and cylinder head of FIG. 10.

FIGS. 10 and 10*a* show cross-sectional and top views, respectively, of another embodiment of the present invention. Fastener 80 includes a head 82, a threaded shank portion 83, and an unthreaded shank portion 84. Fastener 80 further includes a washer 100 placed between bearing surface 85 of fastener head 82 and bearing surface 27 of cylinder head 32. A chamber 88 is formed between the outer diameter of unthreaded and threaded portions 84 and 83, respectively, of the shank and the inner diameter of hole 33 of cylinder head 32.

Washer 100 includes an upper channel 106*a* formed on bearing surface 105*a* and a lower channel 106*b* formed on lower bearing surface 105*b*. Channels 106*a*and 106*b* are formed only part of the way through the thickness of washer 100, thus not splitting the washer. Channels 106*a* and 106*b* provide fluid communication from chamber 88 to an area outside of fastener 80. Although FIG. 10 shows both an upper venting channel 106*a* and a lower venting channel 106*b*, those of ordinary skill in the art will recognize that other embodiments of washer 100 include only one or more upper channels, or one or more lower channels. For example, FIG. 10*a* includes additional channels 107*a* and 107*b* formed in washer 100.

Figure 11:
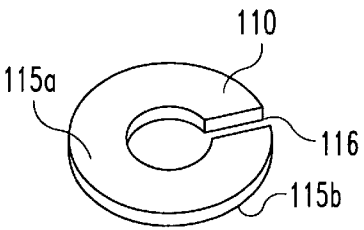
FIG. 11 is an isometric view of a washer according to another embodiment of the present invention.

FIG. 11 depicts another embodiment of the present invention. A washer 110 includes a vent channel 116 which cuts completely through a portion of washer 110. The remaining unsplit portions of washer 110 include a bearing surface 115*a* in contact with the bearing surface of a fastener head, and a lower bearing surface 115*b* in contact with a member such as a cylinder head. The portion of washer 110 including channel 116 has neither an upper bearing surface nor a lower bearing surface above or below channel 116. Washer 110 can be used with fastener 20, for example, to provide venting of chamber 28. In some embodiments of the present invention, washers 100 or 110 are not used within an interior passageway so as to reduce the potential for loose parts being drawn into a cylinder.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus comprising:

an internal combustion engine including a cylinder head defining a hole; and a fastener including a head and a shank, the head having a bearing surface defining at least one channel across a portion of the bearing surface;

wherein said fastener is received within the hole and said bearing surface is in contact with said cylinder head when said fastener threadably couples said cylinder head to said engine, the hole and the shank defining a chamber therebetween, and said channel venting gas from within the chamber;

wherein said cylinder head defines an intake passage for said engine, intake air for said engine flowing through said intake passage, the head of said fastener being exposed to the flowing intake air, said channel venting gas from within the chamber to the intake passage; and which further comprises a block for said engine and a gasket partially sealing portions of said cylinder head from portions of said block, whereby combustion gas flows into the chamber, though said channel, and out to said intake passage;

wherein said fastener head includes four equally spaced channels in the bearing surface.

2. An apparatus comprising:

an internal combustion engine including a cylinder head defining a hole; and a fastener including a head and a shank, the head having a bearing surface defining at least one channel across a portion of the bearing surface;

wherein said fastener is received within the hole and said bearing surface is in contact with said cylinder head when said fastener threadably couples said cylinder head to said engine, the hole and the shank defining a chamber therebetween, and said channel venting gas from within the chamber;

wherein said fastener head includes a plurality of channels.

3. The apparatus of claim 2 wherein said channels are equally spaced in the bearing surface.

4. The apparatus of claim 3 wherein there are four channels.

5. An apparatus comprising:

a first member defining a first hole and a first bearing surface proximate the perimeter of said first hole;

a second member defining a second threaded hole;

a cylindrical shank with two ends and including a threaded portion, said shank being slidable through said first hole, said threaded portion being threadably engageable with the second threaded hole; and a head attached to one end of said shank, said head including a second bearing surface extending from a point near said shank toward the perimeter of said head, said second bearing surface being arranged and constructed to contact said first bearing surface, said first bearing surface including at least one channel;

wherein said second bearing surface contacts said first bearing surface when said shank passes through said first hole and threadably couples to said second hole, said channel providing fluid communication from the exterior of said head to an annular volume formed between said shank and said first hole;

wherein said first hole includes a centerline, and said first bearing surface of said first member includes a channel extending in a direction radially outward from said centerline;

wherein said first bearing surface includes a plurality of radially extending channels.

6. An apparatus comprising:

a first member defining a first hole and a first bearing surface proximate the perimeter of said first hole;

a second member defining a second threaded hole;

a cylindrical shank with two ends and including a threaded portion, said shank being slidable through said first hole, said threaded portion being threadably engageable with the second threaded hole; and a head attached to one end of said shank, said head including a second bearing surface extending from a point near said shank toward the perimeter of said head, said second bearing surface being arranged and constructed to contact said first bearing surface, said second bearing surface including at least one channel;

wherein said second bearing surface contacts said first bearing surface when said shank passes through said first hole and threadably couples to said second hole, said channel providing fluid communication from the exterior of said head to an annular volume formed between said shank and said first hole;

wherein said shank includes a centerline, and said second bearing surface of said head includes a channel extending in a direction radially outward from said centerline;

wherein said second bearing surface includes a plurality of radially extending channels.

7. The apparatus of claim 6 wherein said cylindrical shank and said head comprise a bolt.

8. The apparatus of claim 6 wherein said first member is a cylinder head for an internal combustion engine, said second member is a block for an internal combustion engine, and said channel vents combustion gas from between said cylinder head and said block.

9. The apparatus of claim 6 wherein said first member is a cylinder head for an internal combustion engine, and said channel vents combustion gas leaking into the annular volume.

10. A method for coupling a cylinder head to an internal combustion engine, comprising:

providing a fastener, a first member, and an internal combustion engine including an intake passage;

coupling the first member to the engine with the fastener;

forming a chamber between the fastener and the first member by said coupling;

leaking combustion gas from the engine into the chamber; and venting the combustion gas from the chamber by establishing fluid communication from the chamber to the intake passage.

* * * * *